United States Patent [19]

Barlow

[11] 3,992,006

[45] Nov. 16, 1976

[54] COMPETITIVE BALL GAME APPARATUS

[75] Inventor: Gordon A. Barlow, Skokie, Ill.

[73] Assignee: Marvin Glass & Associates, Chicago, Ill.

[22] Filed: Mar. 18, 1975

[21] Appl. No.: 559,528

[52] U.S. Cl. ..... 273/85 F; 124/6; 124/83; 273/85 D

[51] Int. Cl.[2] ..... A63F 7/06

[58] Field of Search..... 273/26 D, 29 A, 30, 273/85, 96 R, 101, 129, 102.1 C, 119 R, 119 A, 102.1 R; 124/1, 6, 10, 4, 41 R, 30 R, 83

[56] References Cited

UNITED STATES PATENTS

| | | | |
|---|---|---|---|
| 1,163,102 | 12/1915 | Morgan | 273/119 R |
| 1,942,476 | 1/1934 | Harris | 273/119 R |
| 2,668,057 | 2/1954 | Fry | 273/119 R |
| 3,059,929 | 10/1962 | Licitis | 273/96 R |
| 3,172,665 | 3/1965 | Glass et al. | 273/102.1 R |
| 3,375,005 | 3/1968 | Cook | 124/1 |
| 3,548,801 | 12/1970 | Lohr et al. | 273/101 |
| 3,685,829 | 8/1972 | Barlow | 273/101 |
| 3,867,921 | 2/1975 | Politzer | 124/30 R |

*Primary Examiner*—Anton O. Oechsle
*Assistant Examiner*—Harry G. Strappello
*Attorney, Agent, or Firm*—Coffee & Sweeney

[57] ABSTRACT

A competitive game apparatus of the type resembling a table tennis game including a table having opposed playing areas divided by a transverse barrier or "net". The opposed playing areas slope downwardly from the barrier to define a crown below the barrier. A pair of hand manipulatable projecting devices are provided, one for each player of the game, for receiving a substantially hard ball rolling along the playing area and projecting the ball back across the barrier. The playing areas are resiliently supported to dampen the bouncing effect of the ball so that it lands on the playing surface and rolls toward the player down the playing area. Each projecting device is electrically operated and includes a rotatable roller having a resiliently flexible periphery for engaging the ball and directing it through a chute for return to the opposite playing area. The return chute is pivotally mounted on the projecting device so that the player can manually direct the ball to a particular portion of the opposed playing area. The game apparatus also includes a pair of scoring light boxes to tabulate the score for each game and for a plurality of games. The table includes a metal periphery around the playing area so that a substantially different sound is produced as the ball lands outside of the playing area to indicate that a player has missed a shot.

16 Claims, 11 Drawing Figures

90
68
110
104
76
86
66
78
80
14
116
108
114
60
6
74
100
62
64
12

76
88
86
75
104
78
80
60
66
115
114
84
102
108
64
62
74
96
93
94
70
100

68
110
106
106
60
66
104
7
114
115
108
78
7
74
76
100
62
6
64

92
68
60
106
105
92
110
102
66
104
105
C
115
84
108
114
70
100
96
B
64

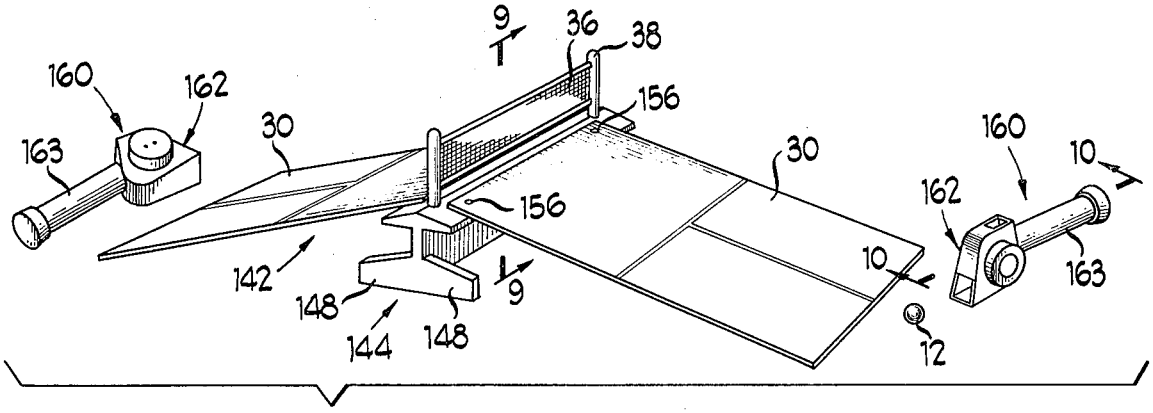
Fig 8
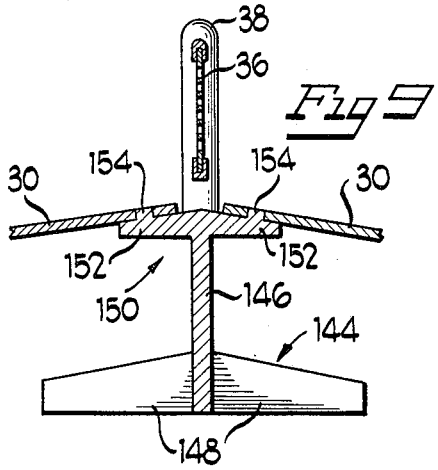
Fig 9
Fig 10
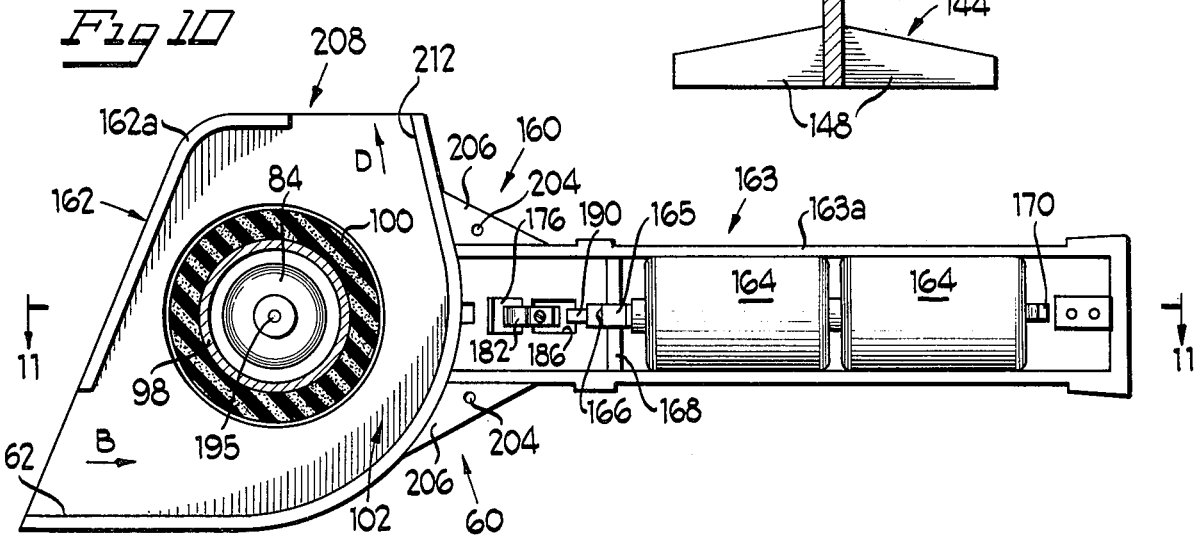
Fig 11
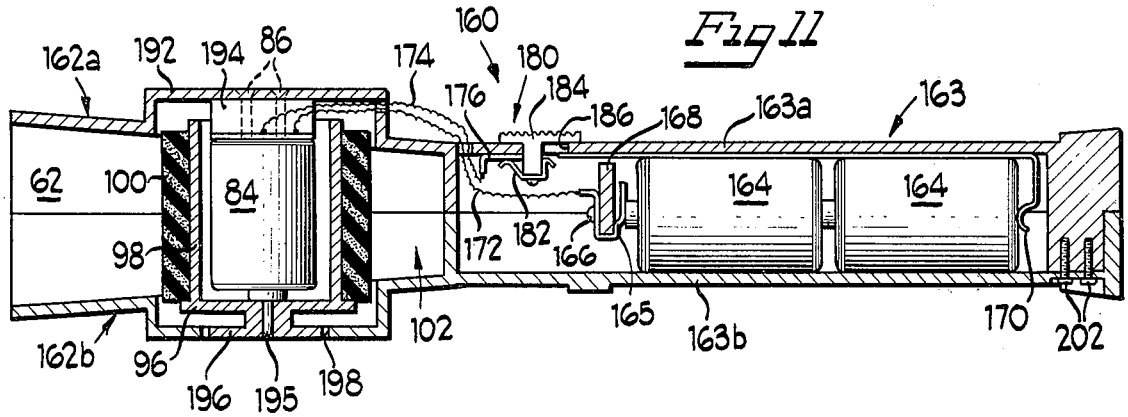

COMPETITIVE BALL GAME APPARATUS

BACKGROUND AND SUMMARY OF THE INVENTION

There are various forms of competitive action games involving a degree of skill wherein opposing players receive and return a ball toward each other. Such games include those where the players directly oppose each other and strike the ball to launch it towards each other, such as table tennis, and those where the players launch the ball toward each other by bouncing it off of an intermediate upright surface, such as handball and the like.

Such direct action physical games have been well received because the participants develop a sense of timing as well as physical dexterity. This invention is directed towards meeting a need and desire in the art to provide a direct action competitive game involving the element of receiving and launching a ball towards opposing players and only limited space is required for the play of the game.

In accordance therewith, the present invention is directed, in brief, to the provision of an improved competitive action game and includes a frame or table having a playing surface supported thereon. The playing surface is sloped downwardly from a generally transverse upstanding central barrier or net defining opposed playing areas. A hard ball is provided and the playing areas are resiliently supported to dampen the rebounding or bouncing effect of the ball as it is projected over the net to permit the ball to roll down the sloped playing surface for receiving by the opposing player. A pair of projecting devices are provided, one for each player of the game, for receiving the ball and launching or projecting the ball across the net onto the opponet's playing area. The projecting devices include a lower chute portion for scooping the ball off of the playing surface and a drive means for directing the ball through an upper chute portion for directing the ball back across the net. The upper chute portion is pivotally mounted to permit the user to direct the ball toward a particular portion of the opposing player's playing area. The drive means includes an electrically driven resilient roller which engages the ball and ejects it through the upper chute portion.

Other objects, features and advantages of the invention will be apparent from the following detailed description taken in connection with the accompanying drawings.

BRIEF DESCRIPTION OF THE DRAWINGS

FIG. 8 is a perspective view of an alternate embodiment of the game apparatus of the present invention;

FIG. 9 is a vertical section, on an enlarged scale, of the playing table taken generally along the line 9—9 of FIG. 8;

FIG. 10 is a vertical section, on an enlarged scale, of one of the projecting devices of the alternate embodiment taken generally along the line 10—10 of FIG. 8; and FIG. 11 is a horizontal section of the projecting device taken generally along the line 11—11 of FIG. 10.

DESCRIPTION OF THE PREFERRED EMBODIMENT

Figure 4:
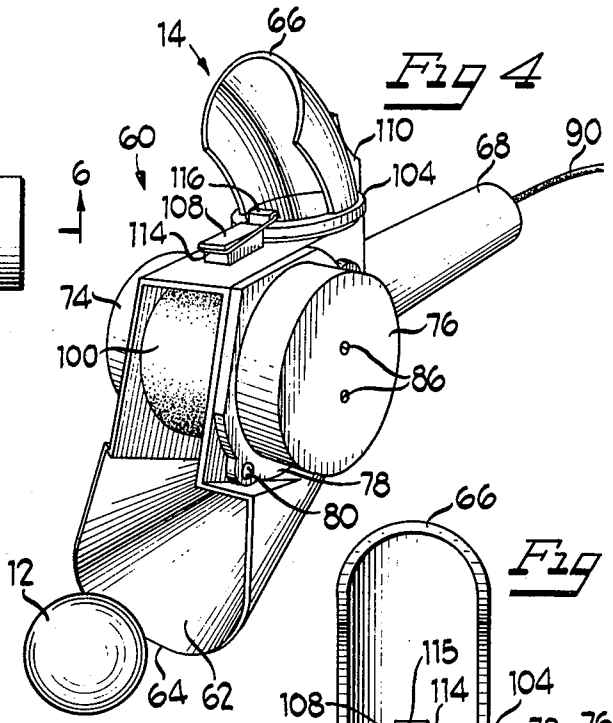
FIG. 4 is a perspective view of the projectile and one of the projecting devices of the present invention.

The competitive game apparatus of the present invention includes a table, generally designated 10 (FIG. 1), a projectile in the form of a hard ball 12, and a hand held ball receiving and projecting device, generally designated 14 (FIG. 4). As will be described in detail hereinafter, the projecting devices are used by the players of the game to receive and launch the ball 12 back and forth towards one another during the play of the game.

Figure 1:
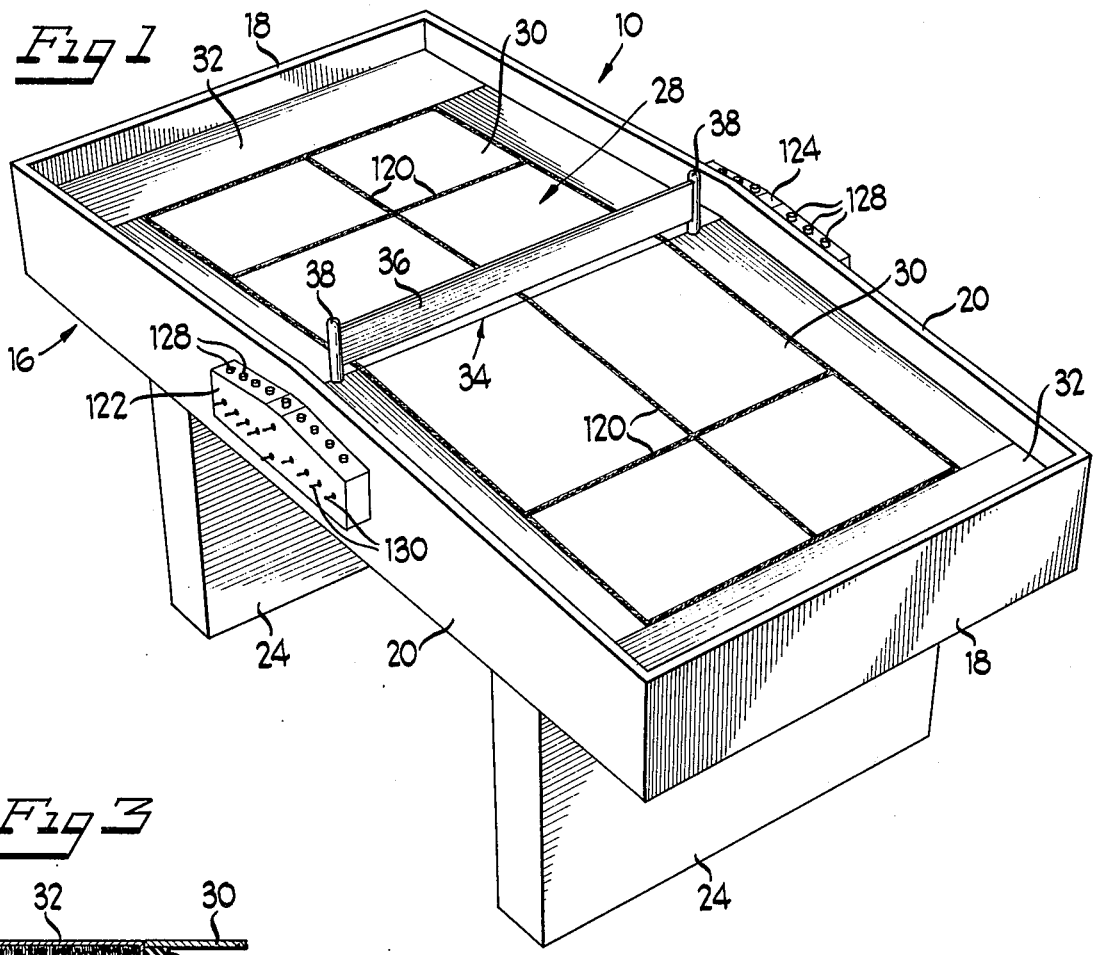
FIG. 1 is a perspective view of the playing table of the present invention.

More particularly, referring to FIG. 1, the table 10 includes a generally rectangular housing, generally designated 16, having end walls 18 and side walls 20. The housing 16 is supported at approximately the waist level of the players of the game by a pair of legs mounted at opposite ends of the table 10. The housing 16 supports a pair of opposed playing areas, generally designated 28, one for each player of the game. The playing areas 28 each include a flat, lined court or inbounds playing area 30 and an out-of-bounds peripheral portion 32 around the courts 30. The playing areas 28 are sloped downwardly away from one another thereby defining a generally transverse crown 34 therebetween. An upright barrier or net 36 is mounted above the crown 34 by a pair of posts 38.

In the embodiments shown, the table 10 and more particularly the playing areas 28 are designed to prevent the ball 12 from bounding when launched by an opponent over the net. The elimination of the bounding of the ball prevents problems such as broken furniture or lost balls as can occur with some competitive action games of this type, for example, table tennis. The ball 12 is made of a hard plastic or the like and the opposed playing areas are dampened to eliminate unnecessary bouncing to keep the ball within the confines of the housing.

Figure 2:
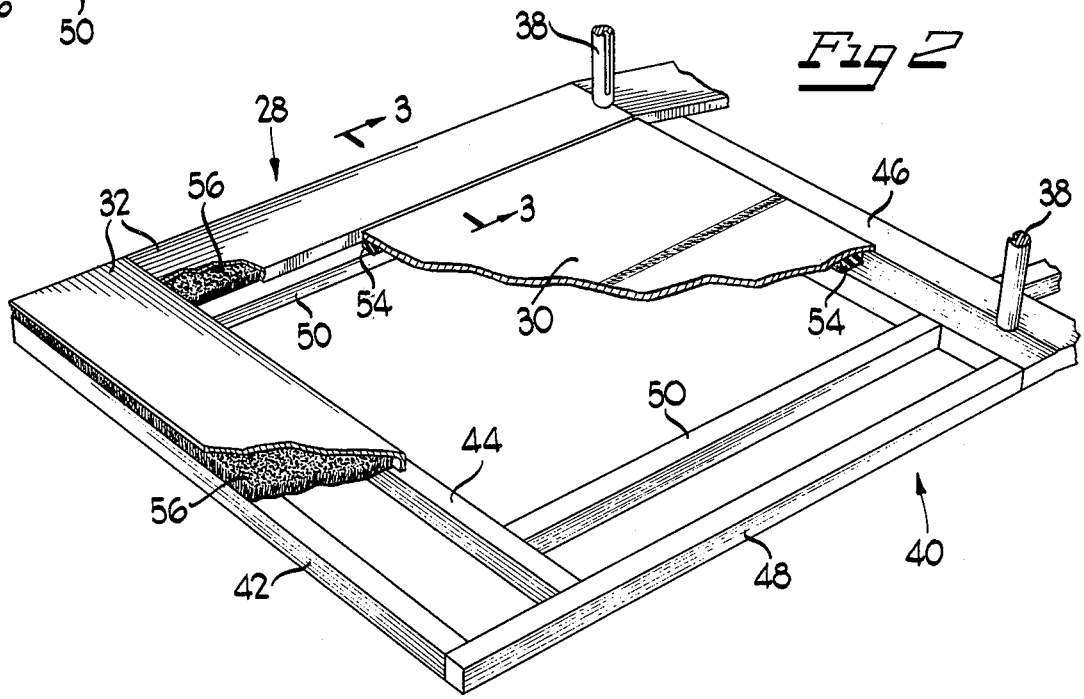
FIG. 2 is a fragmented perspective view, on an enlarged scale, of a portion of the playing surface, showing the particular mounting arrangement therefore.

More particularly, as shown in FIG. 2, the playing area 28 is supported upon a frame, generally designated 40. The frame 40 is identical for each side of the table 10 and therefore will be described with respect to the one shown. The frame 40 includes an outer transverse end member 42, an inner transverse end member 44, and a central transverse member 46 which are connected between the side walls 20 of the housing 16. The transverse members 42, 44 and 46 are interconnected by a pair of outer longitudinal side members 48 connected to the side walls 20 and a pair of inner longitudinal side members 50 which are connected between the transverse members 44 and 56. The court or inbounds are 30 comprises a flat sheet of material such as Masonite or the like which is supported about its periphery by a strip of resilient material 54, such as foam rubber or the like, on the inner longitudinal members 50, the inner transverse member 44 and the center transverse member 46 so that there is a slight amount of "give" or dampening effect as the ball 12 lands on the court area 30.

Figure 3:
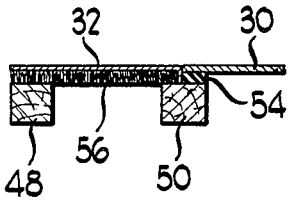
FIG. 3 is a vertical section of the playing surface, taken generally along the line 3—3 of FIG. 2.

The out-of-bounds peripheral area 32 is made of a different type of material to produce a different sound as the ball 12 lands outside of the court area 30. More particularly, as shown in FIGS. 2 and 3, the out-of-bounds area comprises a thin sheet of metal or the like which is supported by a piece of accoustically deadening material 56, as like a carpeting material, which is attached between the members 42, 44, and 48 and 50 respectively. The material 56 serves to deaden the ringing effect as the ball 12 lands outside of the court area on the out-of-bounds portion 32. Thus, with the above described construction, it is very easy for the players of the game to determine whether or not the ball 12 has landed on the court area 30 in order to continue the play of the game.

The playing areas 28 are sloped downwardly and away from one another so that as the ball lands, it begins to roll toward one of the ends 18 of the housing, and can be scooped up from the playing areas 28 by the receiving and projecting device 14.

Referring to FIGS. 4 through 8, the hand manipulatable ball receiving and projecting device 14 enables a player to scoop the ball 12 up from a playing area 28, and the device will automatically return the ball to the opposing playing area. The projection device 14 includes a housing, generally designated 60, having conduit means in the form of a chute having a lower chute portion 62 for receiving the ball 12 from the playing surface 30 or 32. The lower chute portion 62 includes a widened mouth portion 64 (FIG. 6) for sliding engagement with the playing surface to facilitate receiving of the ball 12. The conduit means or chute includes an upper chute portion 66 (FIG. 4) for directing the ball 12 toward the opposite playing area.

A handle 68 is provided on the housing 60 to facilitate holding by the players of the game. A drive means, generally designated 70, is provided on the housing for adding momentum to the ball 12 after it is scooped up to enable it to be launched over the net 36. The housing 60 includes a protruding cylindrical boss portion 74 on the left side as viewed in FIGS. 4 and 6, and an opening 75 in the right side which is closed by a removable cylindrical boss 76. The cylindrical boss 76 includes a flange 78 therearound which is secured to the housing 60 as by screws 80.

Figure 7:
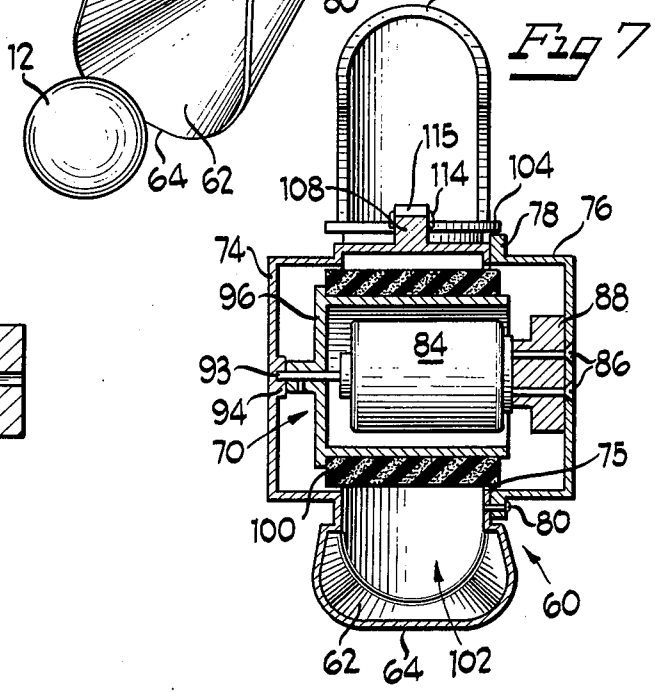
FIG. 7 is another vertical section of the projecting device, taken generally along the line 7—7 of FIG. 5.
Figure 5:
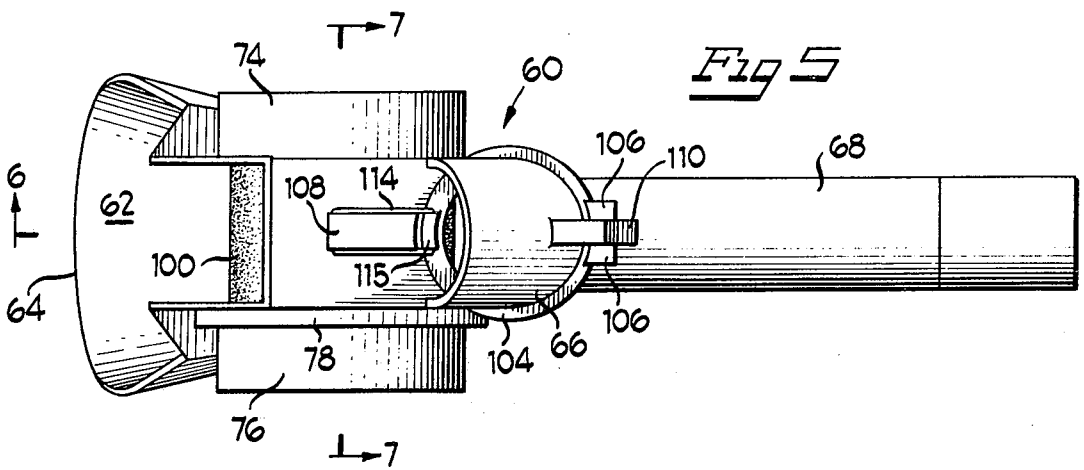
FIG. 5 is a top plan view, on an enlarged scale, of the projecting device of the present invention.
Figure 6:
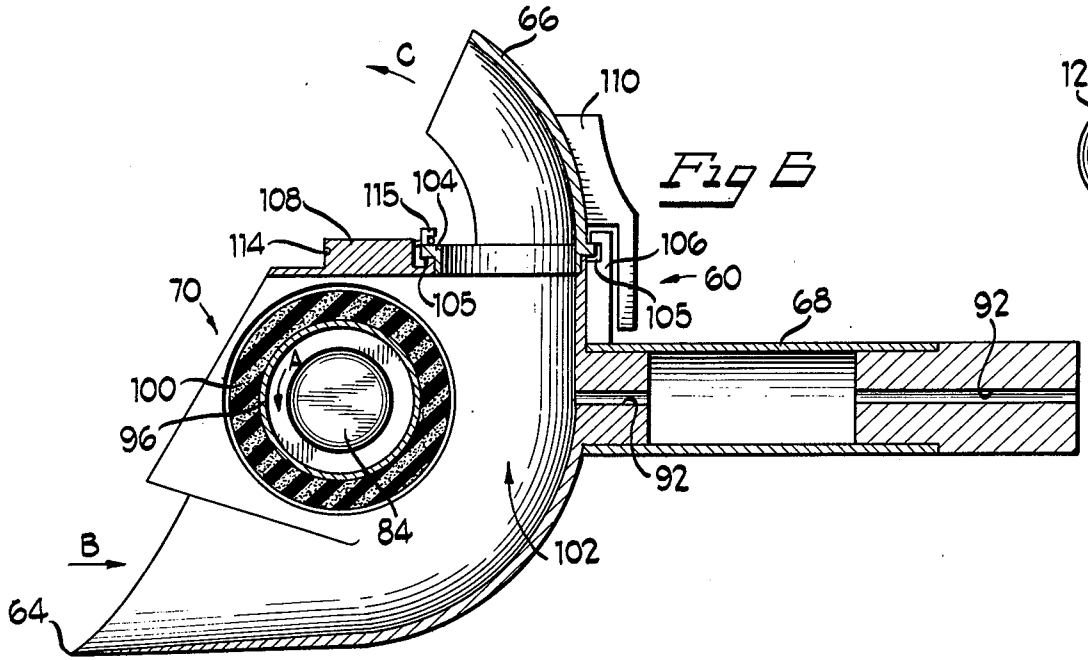
FIG. 6 is a vertical section of the projecting device, taken generally along the line 6—6 of FIG. 5.

Referring to FIG. 7, the drive means 70 include a small electric motor 84 which is mounted to the removable boss 76 by a pair of bolts 86 and spaced apart therefrom by a T-shaped block or spacer 88 so as to be located approximately along the center line of the projecting device 14. The motor 84 is connected to a power source (not shown) by a lead wire 90 (FIG. 4) which exits from the projecting device through a central bore 92 provided along the axis of the handle 68. The motor has a drive shaft 93 which engages a journal 94 provided in the center of the boss portion 74 and mounts a roller which includes as drum 96 for rotation therewith. The drum 96 includes a cylindrical wall portion 98 which substantially encloses the drive motor 84 (FIG. 7). The roller has a soft flexibly resilient covering 100 provided about the periphery of the drum 96 for engagement with the ball 12. More particularly, referring to FIG. 6, the resilient covering 100 is spaced apart from the inside wall of the housing 60 to define conduit means in the form of a channel or chute 102 (FIG. 6) for the ball 12 which is smaller than the diameter of the ball to provide an interference fit between the ball and the resilient covering 100 of the roller 96. When energized, the roller 97 rotates in a counterclockwise direction as shown by arrow A in FIG. 6, so that as the ball enters the chute 62, as shown by the arrow B (FIG. 6), it will engage the roller 97 and be hurled or directed upwardly and outwardly of the upper chute 66, as shown by arrow C (FIG. 7). Thus even a slowly rolling ball 12 can be scooped up from the surface of one of the playing areas 28 and directed upwardly and outwardly through the chute 66 across the net and onto the opposed playing area.

The directing means or upper chute 66 is pivotally mounted to the top of the housing so that it can be manually and selectively rotated, as by a player's thumb while holding the handle 68, in an attempt to control and direct the travel of the exiting ball. Of course, two hands could be used. More particularly, the chute 66 includes a cylindrical flange 104 around the bottom periphery thereof which fits within a pair of U-shaped guides 105 formed in a block 106 on the rear of the housing and a raised block 108 on the forward top portion of the housing. A finger tab 110 is provided on the rearward side of the chute 66 for use by a player to control the direction of the chute 66. As the projecting device 14 is grasped on the handle 68 by a player, the finger tab 110 is within convenient reach of the player's thumb so that it can be easily controlled and rotated.

Resilient means in the form of a rubberband 114 is provided to recenter the projecting device return chute 66 when it is released by the player. More particularly, the resilient band 114 is stretched between an upstanding tab 115 on the flange 104 and the upwardly projecting block 108 on the housing, so that a biasing force must be applied to the finger tab 110 in order to move the chute 66 off of a central alignment. Once the upper chute is moved to either side of a central alignment position, it will automatically be returned when the force is released by the user.

In the preferred embodiment, indicia in the form of a pair of cross lines 120 is provided on the court area 30 to define particular sections or quadrants of the court area 30, similar to a tennis court. According to the rules of the game, a person who is serving or returning the ball 12 to his opposing player may be required to direct the ball to one of the particular quadrants, such as in tennis, to make the game more competitive and stimulating.

A pair of scoring light boxes 122 and 124 are provided on the sides 20 of the housing to assist the players in keeping score. The light boxes 122 and 124 contain a plurality of lights 128 which are controlled by a similar number of toggle switches 130 so that after a particular miss by one fo the players, his opposer may throw one of the toggle switches 130 to light one of the lights indicating a score. If a game is played with rules similar to the game of tennis, the lights may represent a score of luv, 15, 30, 40 and deuce respectively from the outer ends towards the center. It is also contemplated, however, that the light boxes 122 and 124 may be used according to many other rules or conventions.

An alternate embodiment or portable model of the competitive game apparatus of the present invention is illustrated in FIGS. 8–11. The alternate embodiment generally designated 140 (FIG. 8) is referred to as a portable model and can be used by placing the table generaly designated 142 (FIG. 8) on a desk or table or other suitable supporting surface. The portable model 140 may be substantially smaller than the previously described embodiment but many of the elements are the same and like numbers will be used to identify corresponding similar components.

The table 142 includes two inbound playing areas 30 which are sloped downwardly and away from one another and divided by the upright barrier or net 36. The playing areas 30 are supported in their sloped orientation by a generally T-shaped frame, generally designated 144. Referring to FIG. 9, the T-shaped frame 144 includes a generally vertical, transverse support rib 146 which is supported by a plurality of longitudinal flanges 148 which engage the table or other supporting surface. A roof portion, generally designated 150, is provided on the transverse rib 146 for supporting the playing areas 30. The roof 150 includes two downwardly sloping sides 152 each having a pair of upwardly directed pins or studs 154. The studs 154 engage a pair of holes 156 in the playing areas 30 to support the playing areas 30 in their sloped orientation and permit easy removal thereof for storage. The outward ends of the playing areas 30 are merely supported on the table or other surface. The posts 38 are mounted at the ends of the roof portion 150.

FIGS. 10 and 11 illustrate the alternate embodiment or portable model of the projecting devices, generally designated 160. The projecting devices 160 are similar to the formerly described projection devices 14 with a modification to permit them to be battery operated thus obviating the necessity of the electrical cord 90. More particularly, each projection devices 160 includes a housing, generally designated 162, and a handle portion, generally designated 163, for holding by the user. The housing 162 and handle 163 are formed in two halves 162*a* and 163*a* and 162*b* and 163*b* (FIG. 11) to permit easy disassembly as will be described in detail below. The handle 163 provides a housing for a pair of batteries 164 which provide the power for the motor 84. A forward battery contact 165 is mounted by a screw 166 to a transverse rib 168 near the housing. A spring biased rear battery contact 170 is mounted to the inner wall of the handle 68. The forward battery contact 165 is connected by a lead 172 to one pole of the motor 84 and the other pole of the motor 84 is connected by a return lead 174 to a stationary contact 176 near an off-on switch, generally designated 180 (FIG. 11). The off-on switch 180 comprises a movable contact 182 mounted on a thumb control button 184 slidably mounted within a slot 186 in the handle 163*a*. The switch 180 is shown in the "off" position in FIG. 11 and when moved to the "on" position causes the movable contact 182 to span the contacts 176 and a forward extension 190 of the rear battery contact 170 to establish a complete circuit between the batteries 164 and the motor 84 to thereby energize the motor.

The motor 84 is mounted to a boss 192 on the side 162*a* of the housing and spaced apart therefrom by a spacer 194, similar to the spacer 88 of the prior embodiment. The motor 84 includes an output shaft 195 which is secured to the drum 96 to rotate the drum. In this embodiment, the drum includes an additional external flange 196 which serves to close an aperture 198 in the in the side of the housing 162*b*.

The remaining description and components of the projection devices 160 and the motor 84 have been described previously with reference to FIGS. 4–7. The portable or battery operated projecting devices of FIGS. 10 and 11 do not include a rotatable or movable directing means or return chute as described with reference to the prior version. An upper return chute portion, generally designated 208, is provided by a forwardly directed or slanted wall 212 in the housing portions 162*a* and 162*b* which direct the ball, as indicated by arrow D in the top of FIG. 10, to the opponent's side of the net 36 without providing means to vary the direction of the path of travel of the ball 14 other than simply moving the projection device 160. This simplification permits for a simpler and more inexpensive construction as shown.

As previously described, the housing 162 and handle 163 are manufactured in two complementary parts to permit replacement of the batteries 162. More particularly, FIG. 10 shows the half of the housing 162*a* and handle 163*a* which independently supports the motor 84. The other half of the housing 162*b* and handle 163*b* is secured to the first by a pair of screws 202 at the right, rear end of the handle 163 and by another pair of screws (not shown) which are inserted through threaded holes 204 (FIG. 10) in a pair of triangular flanges 206 secured between the housing 162 and the handle 163.

The foregoing detailed description has been given for clearness of understanding only and no unnecessary limitations should be understood therefrom as some modifications will be obvious to those skilled in the art.

I claim:

1. A game apparatus, comprising:

a frame having opposed playing areas thereon, said playing areas sloping downwardly away from one another;

means defining a generally upstanding barrier between the opposed playing areas;

a substantially hard ball movable upon the playing areas;

means at the lowermost end of each playing area to detect a ball out of play and thereby indicate a point score; and a hand manipulatable projecting device for each player of the game, said projecting device having means for receiving a rolling ball from the surface of the playing area and projecting the ball through a vertical arc over the barrier to the opposite playing area.

2. A table tennis type game apparatus, comprising, in combination:

a frame having two generally flat oppositely and downwardly sloped playing areas thereon;

a generally transverse, upstanding barrier between the playing areas;

a playing ball rollably supportable by the playing areas; and a pair of freely movable hand manipulatable electrically driven projecting devices for receiving the ball from the playing area and projecting the ball back towards the opposite playing area, said projecting device including a housing having chute means including a lower ball receiving chute portion and an upper ball return chute portion and electrical drive means mounted on the housing at the chute means for engaging the ball for adding momentum to the ball for launching the ball through the upper return chute portion to the opposite playing area.

3. The game apparatus of claim 2, wherein the upper return chute portion is pivotally mounted to be selectively manually adjustable between a normal, center position and diverging positions on either side of said normal position and includes biasing means to urge said upper chute portion to said center portion to permit the user to direct the projectile to a selected portion of the opposed playing area.

4. The game apparatus of claim 2 wherein the drive means includes an electric motor associated with and mounted substantially within a rotatable drum defining an interference path of travel for the ball between the drum and the chute means to contact the ball and launch the ball through the upper chute portion.

5. The game apparatus of claim 4 wherein the drum includes a resiliently flexible peripheral portion for increasing the friction between the rotatable drum and the ball.

6. The game apparatus of claim 2 wherein the lower receiving chute portion includes a generally flat bottomed widened mouth portion for sliding engagement with the playing surface to facilitate receiving of the ball rolling along the playing area.

7. A pair of opposing playing areas mounted on a frame, said playing areas being inclined downwardly in opposite directions;

an upstanding barrier between the opposed playing areas;

a substantially hard projectile movable upon the playing areas from one side of the barrier to the other;

dampening means between the playing areas and the frame to support the playing areas thereon and substantially negate the reboundability of the projectile for subsequent rolling on the playing surface; and a hand manipulatable projecting device for each player of the game, said projecting device having means for receiving the projectile from the playing surface and automatically projecting the projectile back over the upstanding barrier to the opposite playing area.

8. The game apparatus of claim 7 wherein said projecting device includes a movably mounted upper return chute portion to permit manual adjustment between a normal center position and diverging positions on either side of said normal position and biasing means to urge said upper chute portion to said center position to permit the user to direct the projectile to a selected portion of the opposed playing area.

9. The game apparatus of claim 8 wherein said biasing means is a resilient band.

10. The game apparatus of claim 7 wherein each of the playing areas is a substantially resilient flat sheet supported on the frame by the dampening means.

11. The game apparatus of claim 10 wherein the dampening means includes a strip of resilient material.

12. The game apparatus of claim 7 wherein the projecting device includes a lower projectile receiving chute portion for receiving the projectile from the playing surface and an upper return chute portion for returning the projectile to the opposite playing area.

13. The game apparatus of claim 7 including a peripheral surface around the playing areas, said peripheral surface being made of a different material than said playing areas, so that a different audible signal is produced when the projectile impinges the respective surface to facilitate the play of the game.

14. The game apparatus of claim 13 wherein said peripheral surface is manufactured of a metallic material to produce a pinging sound when impinged by the ball, and includes a dampening support therefor to reduce the length of the time signal is produced.

15. A game apparatus, comprising:

opposed playing areas;

a projectile movable between said playing areas; and a hand manipulatable projecting device for each player of the game, said projecting device having electrical drive means for automatically launching the projectile toward one of said playing areas, said projecting device including a housing defining a cavity for a portable electrical power supply for energizing said electrical drive means, wherein the projecting device includes conduit means for the projectile and said drive means includes a rotatable roller mounted at said conduit means for engaging the projectile and adding projecting velocity thereto and a drive motor mounted on the housing within the interior of the rotatable roller.

16. The game apparatus of claim 15 wherein said projecting device includes an upper chute portion pivotally mounted to the housing adjacent said conduit means for selective manual adjustment thereof to permit aiming of the projectile toward a particular portion of the opposite playing area.

* * * * *